US006053499A

United States Patent [19]

Yiu

[11] Patent Number: 6,053,499

[45] Date of Patent: Apr. 25, 2000

[54] DART BOARD HAVING A FUNCTIONS LOCKING BUTTON

[76] Inventor: Chih-Hao Yiu, 7F-1,No.30,Lin Sen Road, Taichung City, Taiwan

[21] Appl. No.: 09/246,678

[22] Filed: Feb. 8, 1999

[51] Int. Cl.[7] ..... F41J 3/02

[52] U.S. Cl. ..... 273/374; 273/371

[58] Field of Search ..... 273/371–376, 273/377, 403, 404, 407, 408

[56] References Cited

U.S. PATENT DOCUMENTS 4,824,121 4/1989 Beall et al. ..... 273/376

5,553,861 9/1996 Pan ..... 273/371

5,560,617 10/1996 Liang ..... 273/376

5,954,339 9/1999 Yiu ..... 273/371

*Primary Examiner*—Mark S. Graham

*Attorney, Agent, or Firm*—Charles E. Baxley, Esq.

[57] ABSTRACT

A dart board includes a score portion and a control portion which includes a plurality of functions and a locking button which is electrically connected to an integrated circuit board. At least one of the function buttons can be locked by pushing the locking button and the locking function is released by pushing the locking button twice. A start button is located on the control portion and electrically connected to the locking button.

4 Claims, 5 Drawing Sheets

DART BOARD HAVING A FUNCTIONS LOCKING BUTTON

FIELD OF THE INVENTION

The present invention relates to a dart board, and more particularly, to a dart board having a locking button connected with a CPU and an integrated circuit board so that the functions of the dart board can be locked by pushing the locking button.

BACKGROUND OF THE INVENTION

A conventional dart board includes a score portion and a control portion which is generally connected below the score portion. A plurality of buttons are located on the control portion so that types of the game molds can be set by operating the buttons. The score portion has a plurality of rings each which represents a pre-desired scores when the dart is attached thereon, for example single ring, double ring or triple ring. The scores that a player gain is the sum of all the scores represented on the score rings on which the darts are attached by the player. The scores and the sequences in the game will be illustrated on the control portion by inputting data via the buttons. The control buttons are located on the front side of the dart board so that the players can operate the buttons conveniently However, the buttons could be hit by the darts and the wrong data is therefore replace the original data. Worse, once the dart hits the reset button, all the scores will be deleted.

The present invention intends to provide a dart board having a locking button which locks all the function buttons so that even if the darts hit the buttons, the data will not be replaced. The dart board of the present invention provides a locking function to resolve disadvantages of the conventional dart board.

SUMMARY OF THE INVENTION

In accordance with one aspect of the present invention, there is provided a dart board comprising a score portion having a plurality of apertures defined therethrough so that the darts may penetrate the apertures, and a control portion on which a plurality of function buttons and a locking button are located. A conduct layer is located on the back of the score portion. At least one rod extends from the periphery defining the aperture so as to contact the conduct layer when the dart is attached to the score potion. An integrated circuit board having a CPU is electrically connected to the conduct layer and the plurality of function buttons. A locking button is located on the control portion and electrically connected to the integrated board and at least one of the operation buttons. The functions of the function buttons can be locked or released by pushing the locking button.

It is an object of the present invention to provide a locking button on the dart board, which locks the functions of the function buttons so that even if the dart hits the function buttons, the data will not be replaced.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
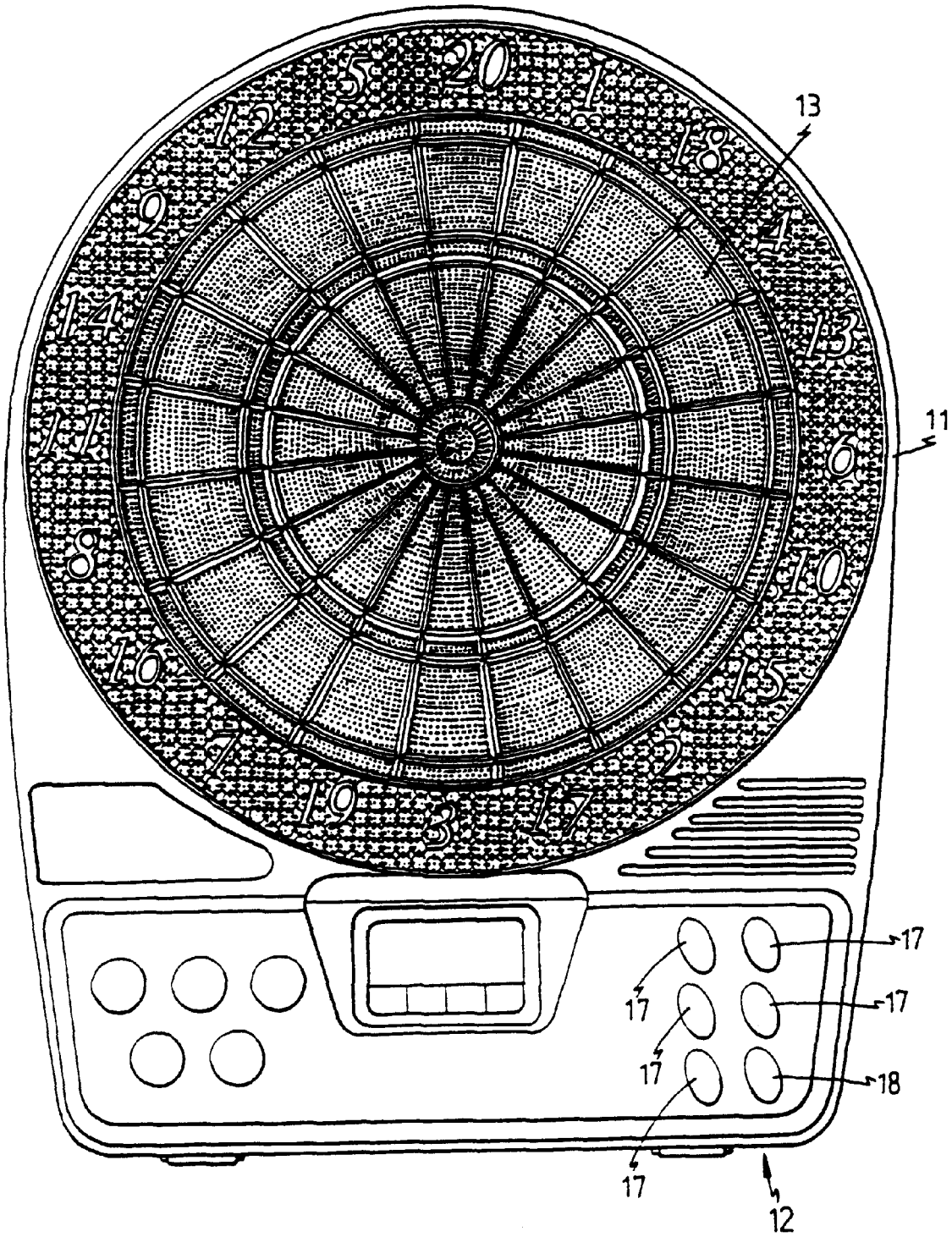
FIG. 1 is a front side view to show the dart board with the control portion in accordance with the present invention.
Figure 2:
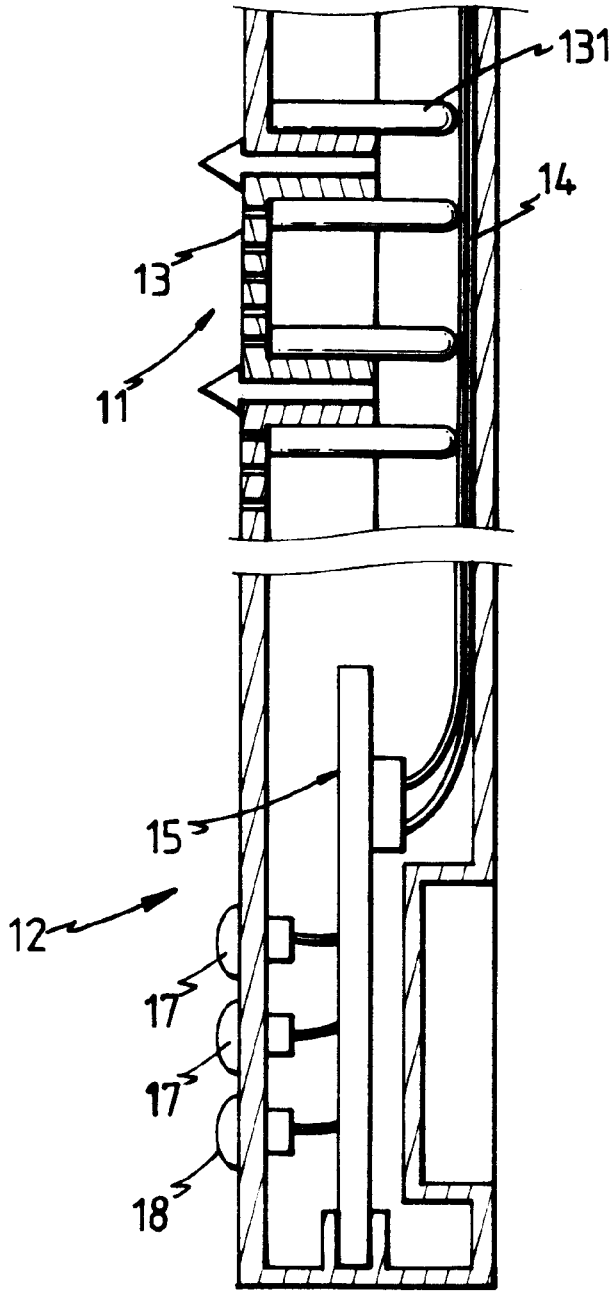
FIG. 2 is a side elevational view, partly in section, of dart portion the in accordance with the present invention.

Referring to FIGS. 1 and 2, the dart board (10) in accordance with the present invention comprises a score portion (11) and a control portion (12) which is connected to the lower end of the score portion (11). The score portion (11) has a plurality of score rings and each of which has a plurality of apertures (13) defined therethrough so that a dart (not shown) may penetrate through the apertures (13). A conduct layer (14) is located on the back of the score portion (11). Two rods (131) extend from the periphery defining each of the apertures (13) and toward the conduct layer (14) with a gap defined between the rods (131) and the conduct layer (14) so that when the dart is attached to the specific aperture (13), the two rods (131) extending from the periphery defining the aperture (13) will hit the conduct layer (14). The control portion (12) has a plurality of function buttons (17), a start button and a locking button (18) located thereon.

Figure 3A:
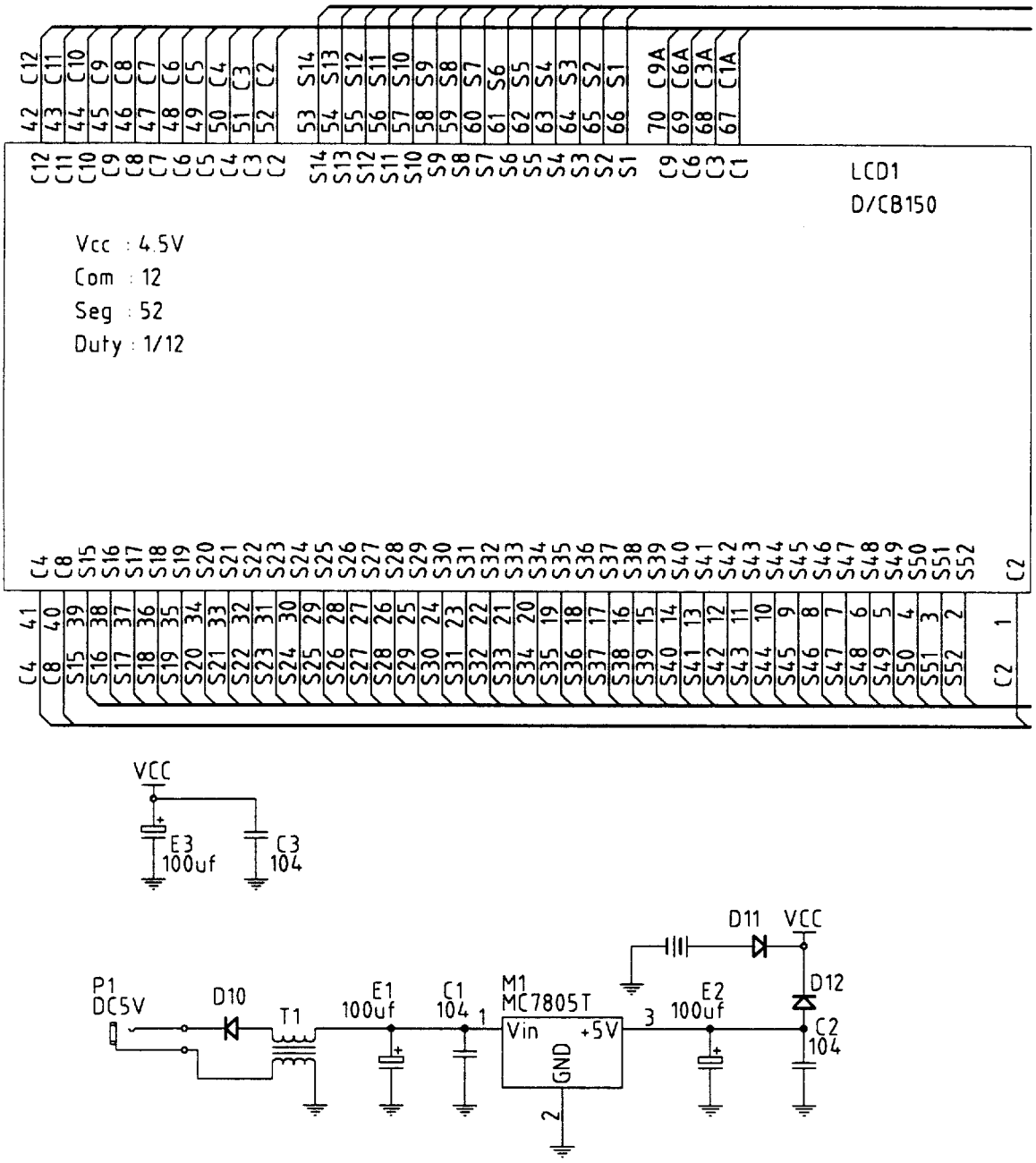
FIG. 3 is an illustrative view to illustrate the circuit of the integrated circuit board in the control portion of the dart board.
Figure 3B:
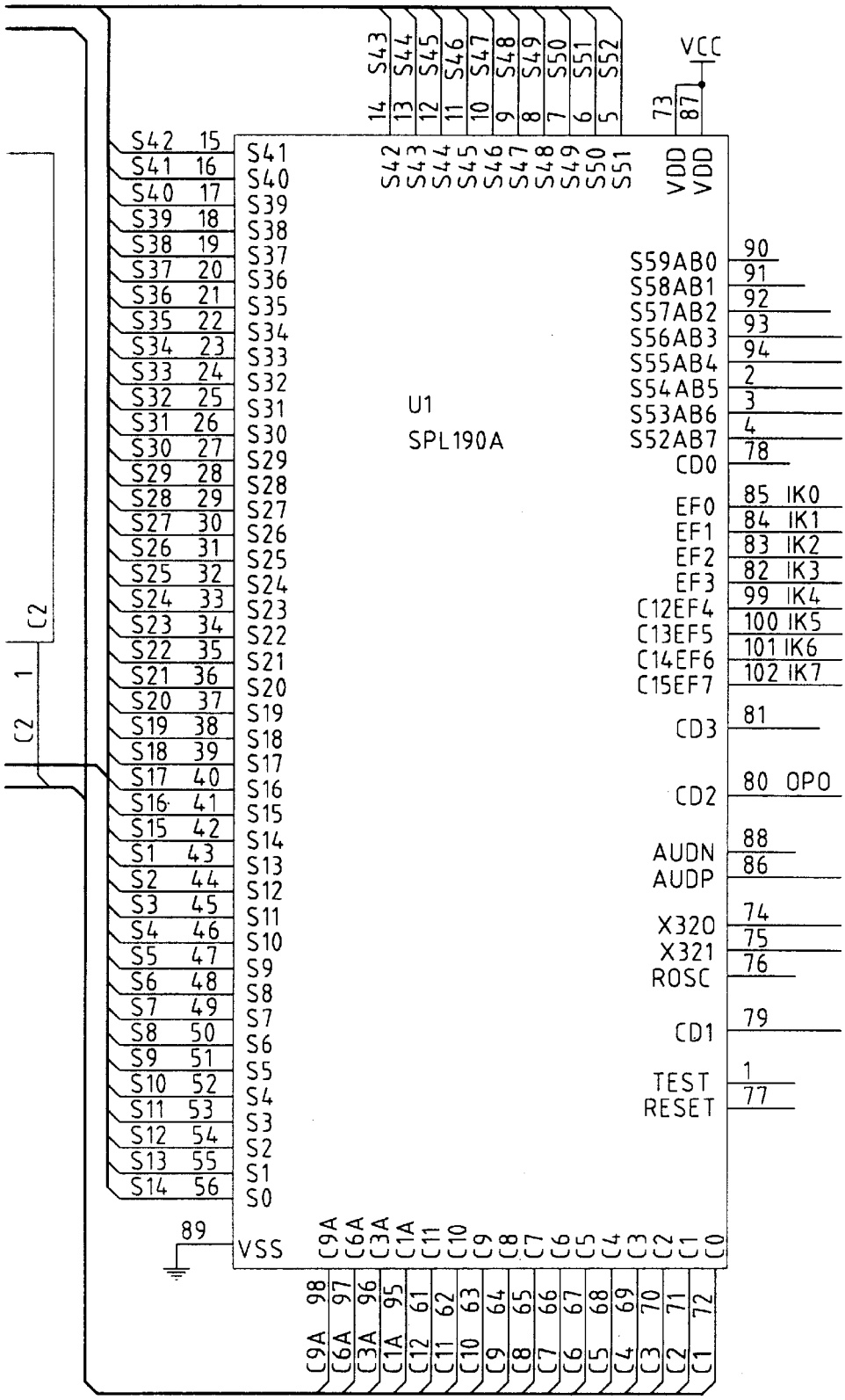
Figure 3C:
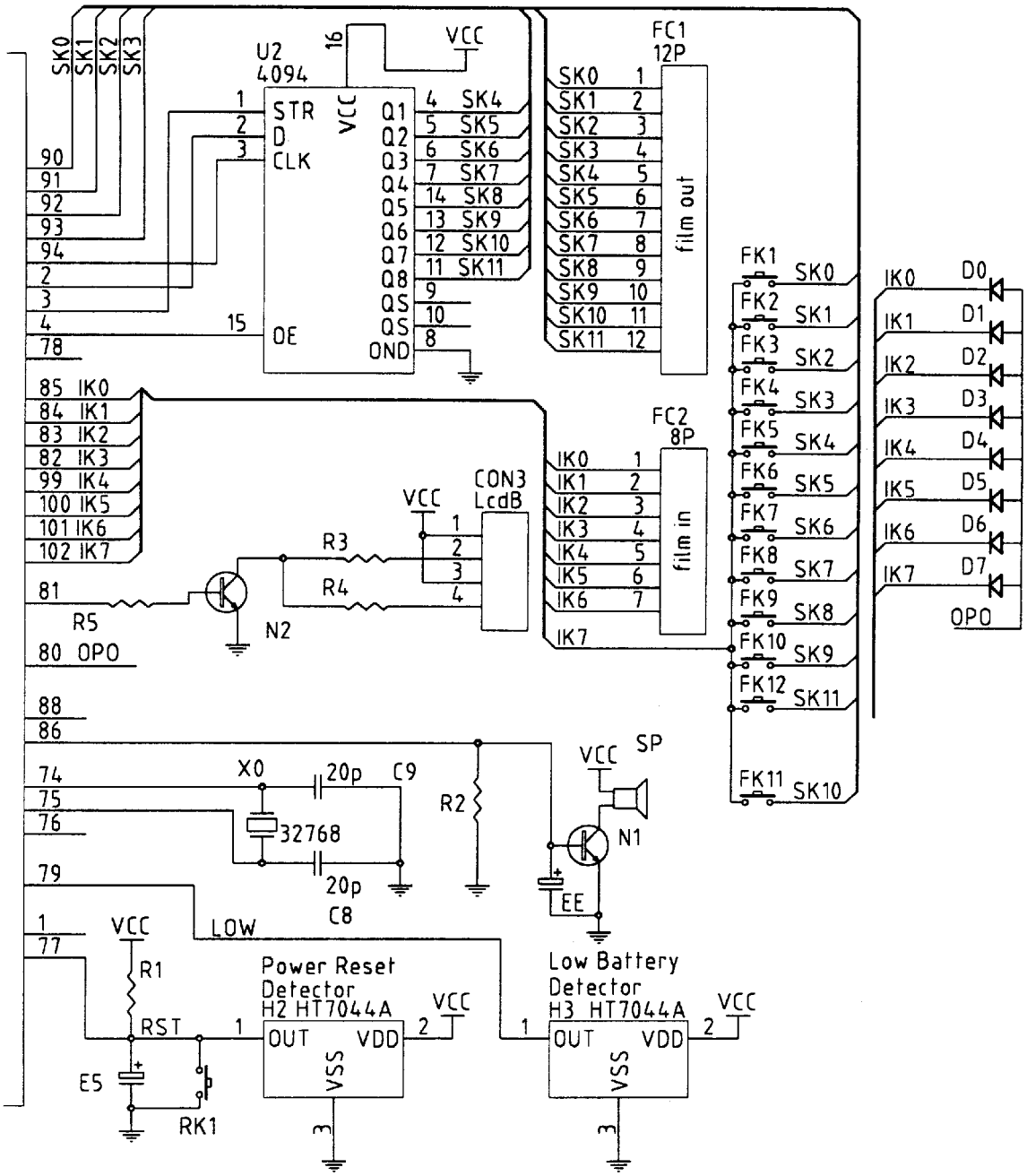

An integrated circuit board (15) has a CPU is electrically connected to the conduct layer (14), the function buttons (17), the start button and the locking bottom (18). The circuit of the integrated circuit board (15) is shown in FIG. 3 The locking button (18) is electrically connected to the integrated board (15) and electrically connected to at least one of the function buttons (17) so that when the locking button (18) is pushed, the function of the function button (17) electrically connected to the locking button (18) is locked. Accordingly, even if the dart hits the function buttons (17) during the game, because the functions of the function buttons (17) are locked the data of the game is still maintained and will not be canceled.

The locking button (18) can be pushed twice to release the locking function so as to set another type of mold of the game. For convenience, the start button is electrically connected to the locking button (18) so that when pushing the start button, the function buttons (17) are all locked.

Although the control portion (12) is located on the front side of the dart board (10), because the function of the function buttons (17) can be locked so that the data during the game will not be changed even if the dart hits the function buttons (17).

While we have shown and described various embodiments in accordance with the present invention, it should be clear to those skilled in the art that further embodiments may be made without departing from the scope and spirit of the present invention.

What is claimed is:

1. A dart board (10) comprising:

a score portion (11) and a control portion (12), said score portion (11) having a plurality of apertures (13) defined therethrough and a conduct layer (14) located on a back of said score portion (11), a plurality of function buttons (17) located on said control portion (12), at least one rod (131) extending from a periphery defining an aperture (13) and towards said conduct layer (14), a gap defined between said at least one rod (131) and said conduct layer (14);

an integrated circuit board (15) electrically connected to said conduct layer (14) and said plurality of function buttons (17), a CPU connected to said integrated circuit board (15), and a locking button (18) located on said control portion (12) and electrically connected to said integrated board (15) and at least one of said function buttons (17).

2. The dart board as claimed in claim 1, wherein said locking button (18) is pushed to lock the function of said at least one function button (17).

3. The dart board as claimed in claim 1, wherein said locking button (18) is pushed twice to release the locking function.

4. The dart board as claimed in claim 1 further comprising a start button which is electrically connected to said locking button (18).

* * * * *